US007185929B2

(12) United States Patent
Moyo

(10) Patent No.: US 7,185,929 B2
(45) Date of Patent: Mar. 6, 2007

(54) DOOR KNOB WITH LIGHT-EMITTING LOCATION INDICATOR AND DOOR

(76) Inventor: Mtinima M. Moyo, 473 Miford St., Apt. 1, Brooklyn, NY (US) 11208

( * ) Notice: Subject to any disclaimer, the term of this patent is extended or adjusted under 35 U.S.C. 154(b) by 78 days.

(21) Appl. No.: 10/677,053

(22) Filed: Oct. 1, 2003

(65) Prior Publication Data

US 2005/0073159 A1 Apr. 7, 2005

(51) Int. Cl.
*E05B 1/00* (2006.01)

(52) U.S. Cl. ..... 292/347; 362/100

(58) Field of Classification Search ..... 292/347, 292/336.3; 16/DIG. 19, 421, 414, 417; 362/100, 362/121

See application file for complete search history.

(56) References Cited

U.S. PATENT DOCUMENTS

| | | | | |
|---|---|---|---|---|
| 1,762,447 | A * | 6/1930 | Lowes | 250/465.1 |
| 2,999,523 | A * | 9/1961 | Amdur et al. | 16/402 |
| 3,024,555 | A * | 3/1962 | Abeles | 40/331 |
| D296,658 | S * | 7/1988 | Mead | D8/305 |
| 4,955,714 | A | 9/1990 | Stotler et al. | |
| 4,981,314 | A * | 1/1991 | Carr | 292/347 |
| 5,008,551 | A | 4/1991 | Randolph | |
| 5,217,763 | A | 6/1993 | Boury | |
| 5,664,446 | A * | 9/1997 | Kusmiss | 70/330 |
| 6,132,057 | A | 10/2000 | Williams | |
| 6,305,032 | B1 * | 10/2001 | Jones | 4/246.1 |
| 6,394,511 | B1 * | 5/2002 | Lam et al. | 292/336.3 |
| 6,461,012 | B1 | 10/2002 | Shuman | |
| 6,555,215 | B2 * | 4/2003 | Pitts | 428/315.5 |
| 6,704,967 | B2 * | 3/2004 | Gianelli et al. | 16/422 |

* cited by examiner

*Primary Examiner*—Gary Estremsky
(74) *Attorney, Agent, or Firm*—Charles E. Bruzga; Bruzga & Associates

(57) ABSTRACT

A door knob with a light-emitting location indicator comprises a knob designed for placement on a door, for being grasped by the hand of a user for opening the door. The knob comprises translucent material. One or more objects comprising light-emitting material that either phosphoresces or luminesces are mounted within the knob and are visible through a protective layer of translucent material. The light-emitting material is designed to emit light in a darkened space to thereby visually indicate the location of the knob in the darkened space.

44 Claims, 5 Drawing Sheets

DOOR KNOB WITH LIGHT-EMITTING LOCATION INDICATOR AND DOOR

FIELD OF THE INVENTION

The present invention relates to a door knob that includes a light-emitting indication of its location, which is especially useful in a darkened location.

BACKGROUND OF THE INVENTION

Door knobs are placed on doors that open to allow humans to pass through a doorway, for example. Door knobs are also provided on doors for cabinets and drawers of a chest of drawers, for instance. In a darkened location, it would be desirable to provide light-emitting elements associated with a door knob to visually indicate the location of the door knob. It would be desirable to have the light-emitting elements function without an electrical power source, such as batteries.

The prior art generally addresses these concerns. For instance, U.S. Pat. No. 4,981,314 discloses a doorknob having various portions of an adornment on a door knob treated with a phosphorescent or luminescent material to produce a glowing effect at night or in the dark.

While the foregoing patent generally addresses the foregoing concerns, other concerns are not addressed. For instance, the light-emitting material, phosphorescent or luminescent, of the foregoing patent is exposed to the environment. Such light-emitting material is susceptible to degradation from external influences such as dirt, grime, or perspiration, for instance, from contact by a person's hand. Further, such light-emitting material is subject to wear and tear from abrasion with objects such as a person's hand or a key for a lock in, or near, the knob. Further, it may be desirable to protect one's hand from close contact with some light-emitting material, such as luminescent material energized from a radioactive salt, that could be harmful to a person.

Accordingly, it would be desirable to provide a door knob with a light-emitting location indicator that addresses the foregoing concerns.

SUMMARY OF THE INVENTION

In accordance with one form of the invention, a door knob with a light-emitting location indicator comprises a knob designed for placement on a door, for being grasped by the hand of a user for opening the door. The knob comprises translucent material. One or more objects comprising light-emitting material that either phosphoresces or luminesces are mounted within the knob and are visible through a protective layer of translucent material. The light-emitting material is designed to emit light in a darkened space to thereby visually indicate the location of the knob in the darkened space.

The objects of light-emitting material may comprise a base material that has been painted with paint containing light-emitting material, or it may fully comprise light-emitting material that may be solid or hollow, or some combination of these. As used in this specification and claims, "light-emitting material" embraces the foregoing alternative possibilities.

The light-emitting material in the foregoing door knob is both protected from the environment as well as serving to protect (or prevent) a person from contact with the light-emitting material. As such, the concerns mentioned above are addressed, such as protecting the light-emitting material from degradation due to contact with the environment, for instance.

Other features and objects of the invention will become apparent from the remainder of this specification.

DETAILED DESCRIPTION OF THE INVENTION

Figure 1:
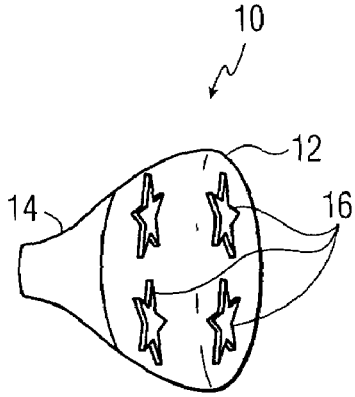
FIG. 1 is side view in perspective of a door knob in accordance with an embodiment of the invention.
Figure 2:
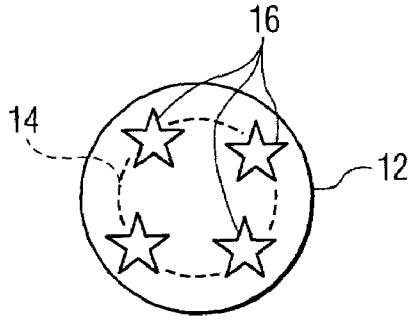
FIG. 2 is a front view of the door knob of FIG. 1.

FIG. 1 shows a door knob 10 having a translucent section 12 and a mounting section 14. As shown in FIGS. 1 and 2, translucent section 12 contains one or more objects 16 comprising light-emitting material that either phosphoresce or luminesce, so as to visually indicate the location of the knob in a darkened space. The term "light-emitting material" is defined above, and includes, for instance, paint including light-emitting material that covers a base material which does not emit light.

Figure 3:
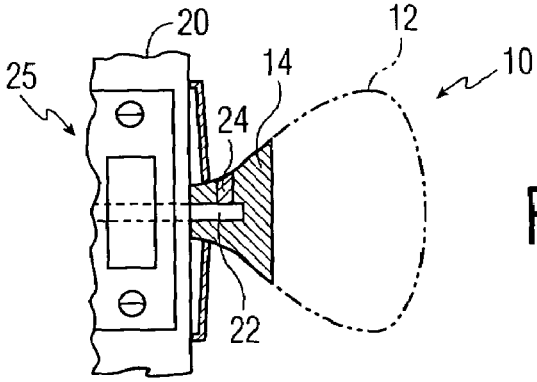
FIG. 3 is a fragmentary side view, partially in section, and partially in simplified form, of the left-side portion of the door knob of FIG. 1, showing an arrangement for mounting the knob on a door that closes a passage for human access.
Figure 4:
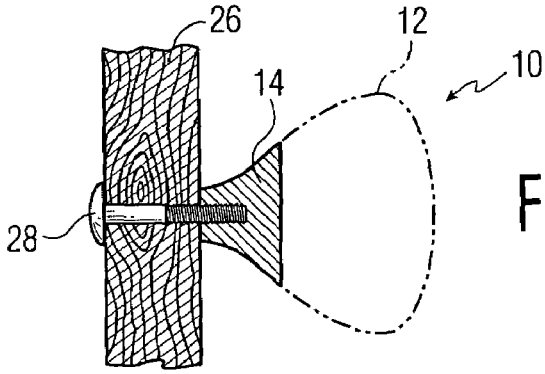
FIG. 4 is a side view, partially in section and partially in simplified form, similar to FIG. 3, but showing an arrangement for mounting the knob to a door of a cabinet, for instance.

Translucent section 12 may comprise plastic or other material suitable for use as a door knob, and may be transparent. Section 14 is a section for mounting to a door. FIG. 3 shows knob 10 mounted to a door 20 used to close a doorway for human access. Translucent section 12 is shown in simplified form with phantom lines. Mounting section 14, which may be metal or plastic, for instance, is held to a shaft 22 by a screw 24 in conventional manner. Shaft 22 controls a door latch 25 in conventional manner. FIG. 4 shows an alternative mounting section 14 connected to a door 26 of a cabinet by a screw 28. As in FIG. 3, translucent section 12 is shown in simplified form with phantom lines.

Figure 5:
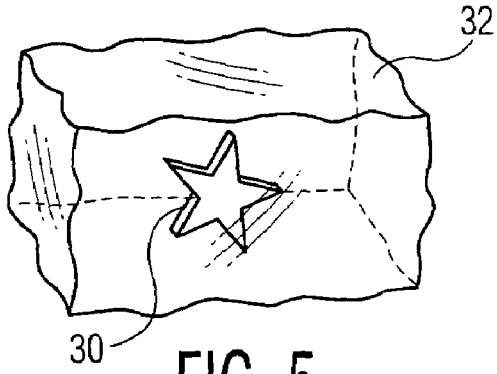
FIG. 5 shows a sectional fragment of translucent material of the door knob of FIG. 1, containing a object comprising light-emitting material.

FIG. 5 shows a feature of the invention of an object 30 comprising light-emitting material that is visible through a protective layer of translucent material 32 of translucent section 12 of knob 10 of FIG. 1. Preferably, object 30 is completely surrounded by translucent material 32. More preferably, substantially the entire outer surface of object 30 is intimately surrounded by translucent material 32, for optimum protection of the object.

Preferably, the shapes of the objects comprising light-emitting material are selected to provide a visual interest differing from that of a mere door knob. This can be done by shaping the light-emitting objects in the form of an adornment or scene differing from that of a door knob.

In providing visual interest, one or more of the shapes preferably have respective outlines that are non-circular. For instance, object 30 (FIG. 5) shows a polygonal (star) shape. More preferably, one or more of the outlines may comprise a multi-pointed shape, such as a star shape 36 shown in FIG. 6. The reason is that a multi-pointed shape has a relatively strong attention-focusing power, so as to provide a more prominent visual indication of the location of the door knob in a darkened space.

Figure 6:
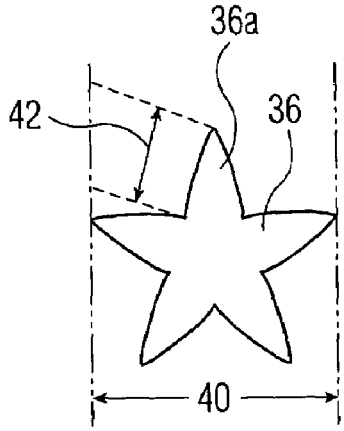
FIG. 6 shows a star-shaped object comprising light-emitting material, showing various dimensions of the star shape.
Figure 7:
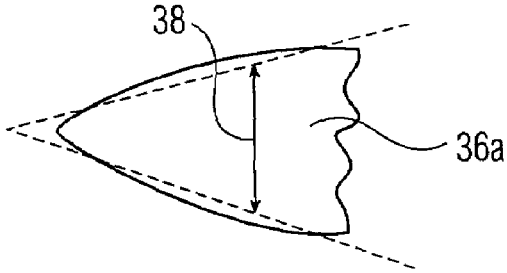
FIG. 7 shows a fragment of the star shape of FIG. 6 in enlarged form, showing an approximation of an angle of a point.

Guidelines for making prominent points on a shape are described with reference to FIGS. 6 and 7. Preferably, each point 36*a* (FIG. 7), for instance, approximates an angle 38 substantially less than 90 degrees, and preferably below about 65 degrees, with the length 42 of each point (e.g., 36*a*) being at least about 15 percent of the maximum dimension 40 (FIG. 6) of an outline of the shape, and more preferably at least about 25 percent of the maximum dimension 40.

Figure 8:
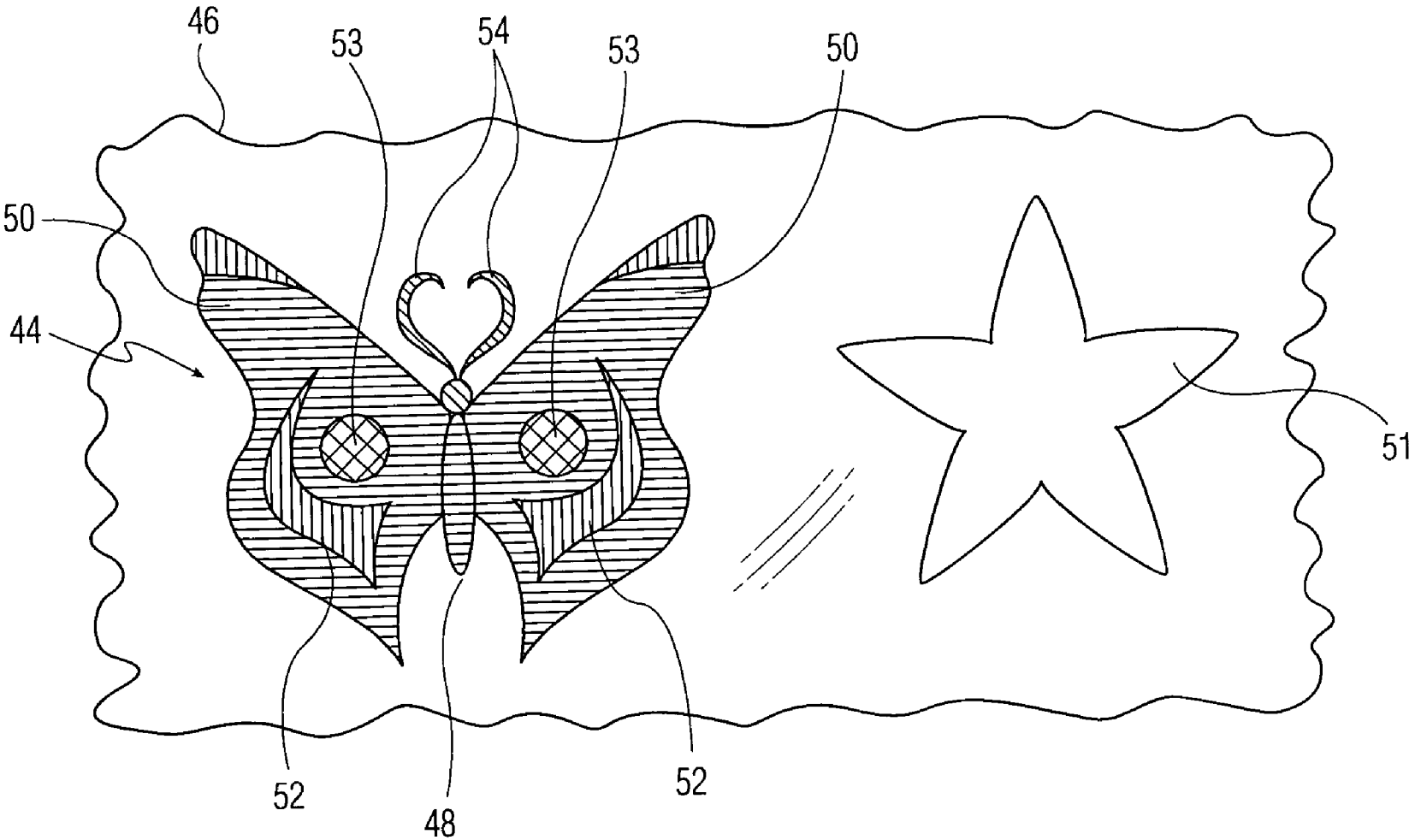
FIG. 8 shows a fragment of translucent material containing two objects each comprising light-emitting material.

As shown in FIG. 8, visual interest can also be imparted to an object comprising light-emitting material by forming it with at least two portions that emit light in respectively different colors. For instance, a butterfly shape 44 in translucent material 46 of a door knob comprises blue portions 48 and 50, pink portions 52, orange portions 53, and green portions 54. All of these portions may emit light, or, for instance, orange portions 53 might not emit light. The combination of such multiple, light-emitting or non-light emitting colors gives a high degree of visual interest to butterfly shape 44, and is pleasing to observe. Additional visual interest is provided by providing another object 51 comprising light-emitting material.

Figure 9:
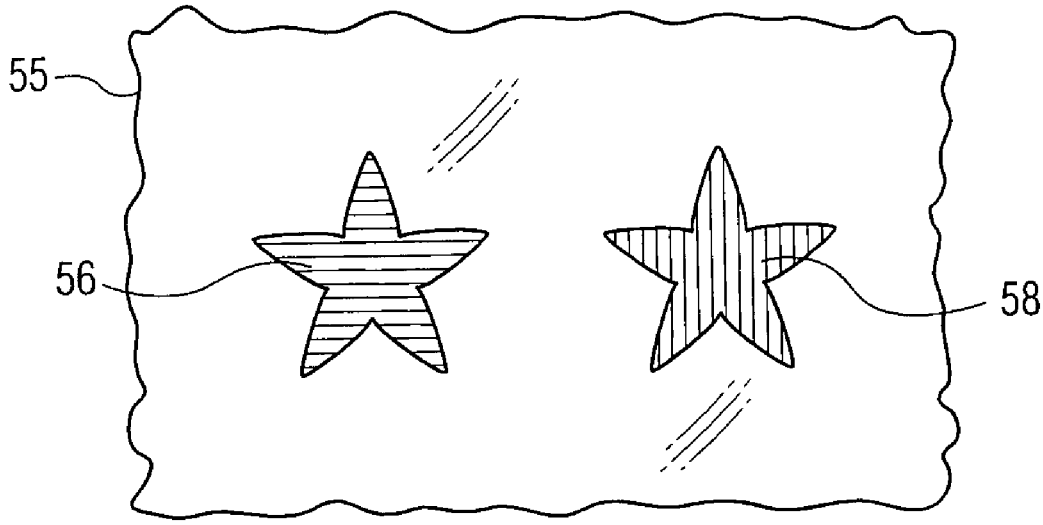
FIG. 9 shows a fragment of translucent material containing two objects comprising light-emitting material having substantially the same shape.

Another way of adding visual interest to objects comprising light-emitting material is to include at least two objects that emit light in respectively different colors, which may be respective, single colors. Thus, FIG. 9 shows, in translucent material 55 of a door knob, a star shaped object 56 of material that emits light only in blue and a star-shaped object 58 of material that emits light only in pink. Objects 56 and 58 are separated from each other.

Figure 10:
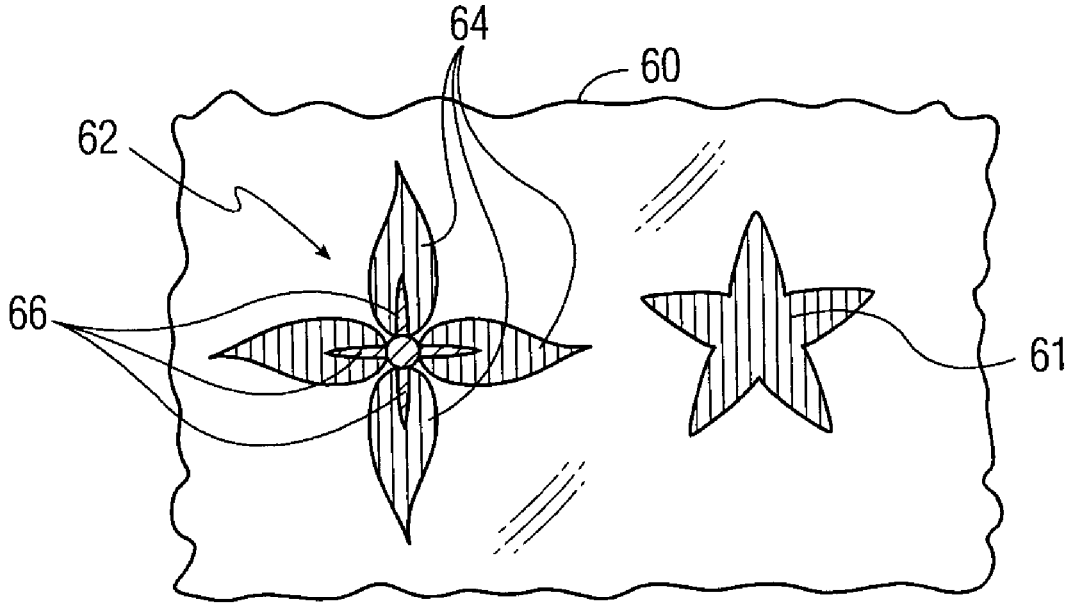
FIG. 10 shows a fragment of translucent material containing an object comprising both light-emitting material and material that does not emit light.

A still further way of adding visual interest to an object comprising light-emitting material is to include one or more non-light-emitting portions visible in daylight. For instance, FIG. 10 shows, in translucent material 60 of a door knob, a flower-shaped object 62 with portions 64 that emit light in pink, whereas interior portions 66 of the object comprise non-light-emitting portions 66 that are brown. Flower-shaped object 62 will have a considerably different appearance in a darkened space than in daylight. This adds a changing perspective to the visual appearance of the object. Additionally, the inclusion in translucent material 60 of another object 61 comprising light-emitting material adds more visual interest.

Figure 11:
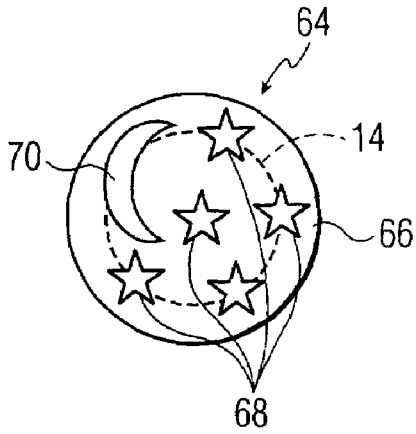
FIG. 11 shows a front view of a door knob containing objects comprising entirely light-emitting material together with a separate object comprising material that does not emit light.

FIG. 11 shows a door knob 64 including a translucent section 66 and a mounting section 14. Contained within translucent section 66 are objects 68 with outlines of stars and an object 70 with an outline of a crescent moon. The portions of star-shaped objects 68 visible in FIG. 11 are entirely light-emitting. In contrast, the visible portion of crescent moon-shaped object 70 is non-light emitting. This creates a type of changing perspective to the visual appearance of the objects that differs from that described in connection with FIG. 10. Of course, not all portions of objects 68 need to emit light, as is apparent from the above discussion of FIG. 10.

Figure 12:
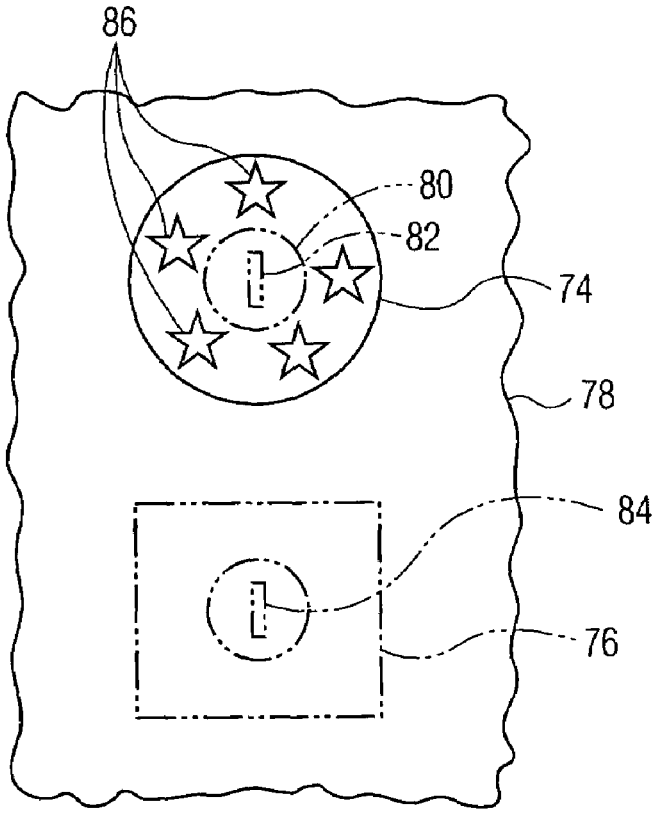
FIG. 12 shows a front view of a door knob and alternative locking mechanisms, mounted on a fragment of a door.

FIG. 12 shows a door knob 74 and optional locking mechanism 76 mounted on a door 78. Knob 74 may contain an optional locking mechanism 80 having a keyhole 82 for receiving a key (not shown). Similarly, optional locking mechanism 76 includes a keyhole 84 for receiving a key (now shown). With both locking mechanisms, a person over time may repeatedly press a key towards one of the keyholes and might miss the keyhole. According to an aspect of the invention, objects 86, within knob 74, comprising light-emitting material are protected from damage due to a person missing the keyhole and accidentally pressing the key against the knob.

While the invention has been described with respect to specific embodiments by way of illustration, many modifications and changes will occur to those of ordinary skill in the art. It is, therefore, to be understood that the appended claims are intended to cover all such modifications and changes as fall within the true spirit and scope of the invention.

What is claimed is:

1. Door knob having light-emitting location indicator and door, comprising:

a) a vertically inclined door;

b) a door latch mounted in the door;

c) a shaft for controlling the door latch; the shaft having a main, rotational axis; the rotational axis extending orthogonally away from a main surface of the door;

d) a door knob held to the shaft and comprising protective translucent material;

e) at least one object comprising light-emitting material that either phosphoresces or luminesces, without an electrical power source, mounted within the knob and being visible through the protective translucent material;

f) the at least one object being sized sufficiently smaller from the size of the protective translucent material so that the at least one object appears as different from said protective translucent material;

g) the light-emitting material being designed to emit light in a darkened space to thereby visually indicate the location of the knob in the darkened space; and h) the at least one object being sufficiently surrounded by the protective translucent material as to appear floating within the protective translucent material as viewed in a direction parallel to said main surface.

2. The combination of claim 1, wherein the door is large enough to allow humans to walk through a doorway that is selectively closed by the door.

3. The combination of claim 1, wherein the at least one object comprises two or more objects.

4. The combination of claim 1, wherein the translucent material is substantially transparent.

5. The combination of claim 1, wherein substantially the entire outer surface of each of the at least one object is each substantially intimately surrounded by translucent material.

6. The combination of claim 1, wherein the at least one object defines a plurality of substantially similar shapes spaced from each other.

7. The combination of claim 6, wherein the shapes have respective outlines which are non-circular, each defining a multi-pointed shape.

8. The combination of claim 7, wherein the at least one object is sufficiently surrounded by the protective translucent material as to appear floating as the at least one object is viewed along all directions parallel to said main surface.

9. The combination of claim 7, wherein the non-circular outlines each define a substantially polygonal shape.

10. The combination of claim 1, wherein the at least one object comprises at least two objects spatially separated from each other along said rotational axis.

11. The combination of claim 10, wherein the at least two objects comprise a pair of objects, each being sufficiently surrounded by the protective translucent material as to appear floating within the protective translucent material as viewed in a direction parallel to said main surface.

12. The combination of claim 1, wherein at least one of the at least one object contains at least two portions that emit light in respectively different colors.

13. The combination of claim 1, wherein at least one of the at least one object further comprises a non-light-emitting portion visible in daylight.

14. The combination of claim 13, wherein the non-light emitting portion comprises less than 20 percent of the surface of the object.

15. The combination of claim 14, wherein the non-light emitting portion comprises at least two portions of respectively different colors.

16. The combination of claim 1, further including a non-light emitting object mounted within the knob, visually contrasting with the translucent material, and being visible through protective translucent material.

17. The combination of claim 16, wherein the non-light-emitting object is spaced from at least one object comprising light-emitting material.

18. The combination of claim 1, wherein the knob includes a looking mechanism with a keyhole in the vicinity of the at least one object.

19. Door knob having light-emitting location indicator and door, comprising:

a) a vertically inclined door;

b) a door knob directly or indirectly mounted to the door; the door knob comprising:

i) a main axis orthogonal to a main surface of the door;

ii) protective translucent material having a maximum cross-sectional area taken along said main axis; and iii) a portion of the door knob having a surface adjacent the door; the foregoing surface having a cross-sectional area taken along the main axis;

iv) said maximum cross-sectional area being at least twice as large as said cross-sectional area of said portion of the door knob;

c) at least one object comprising light-emitting material that either phosphoresces or luminesces, without an electrical power source, mounted within the knob and being visible through the protective translucent material;

d) the at least one object being sized sufficiently smaller from the size of the protective translucent material so that the at least one object appears as different from said protective translucent material;

e) the light-emitting material being designed to emit light in a darkened space to thereby visually indicate the location of the knob in the darkened space; and f) the at least one object being sufficiently surrounded by the protective translucent material as to appear floating within the protective translucent material as viewed in a direction parallel to said main surface.

20. The combination of claim 19, wherein:

a) the knob is mounted to the door directly or indirectly by a shaft having a portion extending into the knob;

b) said portion extending into the knob being situated along said main axis between the door and the at least one object.

21. The combination of claim 19, wherein the door is large enough to allow humans to walk through a doorway that is selectively closed by the door.

22. The combination of claim 19, wherein the at least one object comprises two or more objects.

23. The combination of claim 19, wherein the translucent material is substantially transparent.

24. The combination of claim 19, wherein substantially the entire outer surface of each of the at least one object is each substantially intimately surrounded by translucent material.

25. The combination of claim 19, wherein the at least one object defines a plurality of substantially similar shapes spaced from each other.

26. The combination of claim 25, wherein the shapes have respective outlines which are non-circular, each defining a multi-pointed shape.

27. The combination of claim 26, wherein the at least one object is sufficiently surrounded by the protective translucent material as to appear floating as the at least one object is viewed along all directions parallel to said main surface.

28. The combination of claim 26, wherein the non-circular outlines each define a substantially polygonal shape.

29. The combination of claim 19, wherein the at least one object comprises at least two objects spatially separated from each other along said main axis.

30. The combination of claim 29, wherein the at least two objects comprise a pair of objects, each being sufficiently surrounded by the protective translucent material as to appear floating within the protective translucent material as viewed in a direction parallel to said main surface.

31. The combination of claim 19, wherein at least one of the at least one object contains at least two portions that emit light in respectively different colors.

32. The combination of claim 19, wherein at least one of the at least one object further comprises a non-light-emitting portion visible in daylight.

33. The combination of claim 32, wherein the non-light emitting portion comprises less than 20 percent of the surface of the object.

34. The combination of claim 33, wherein the non-light emitting portion comprises at least two portions of respectively different colors.

35. The combination of claim 19, further including a non-light emitting object mounted within the knob, visually contrasting with the translucent material, and being visible through protective translucent material.

36. The combination of claim 35, wherein the non-light-emitting object is spaced from at least one object comprising light-emitting material.

37. The combination of claim 19, wherein the knob includes a locking mechanism with a keyhole in the vicinity of the at least one object.

38. Door knob with light-emitting location indicator, comprising:

a) a knob designed for placement on a vertically inclined door, for being grasped by the hand of a user for opening the door; the knob comprising translucent material;

b) at least one object comprising light-emitting material that either phosphoresces or luminesces, without an electrical power source, mounted within the knob and being visible through a protective layer of translucent material;

c) the at least one object being sized sufficiently smaller from the size of the protective translucent material so that the at least one object appears as different from said protective translucent material;

d) the light-emitting material being designed to emit light in a darkened space to thereby visually indicate the location of the knob in the darkened space;

e) the at least one object being sufficiently surrounded by the protective translucent material as to appear floating within the protective translucent material from an axial side of the knob; and f) the knob including a locking mechanism with a keyhole in the vicinity of the at least one object.

39. The combination of the door knob of claim 38 and a locking mechanism with a keyhole in the vicinity of the at least one object.

40. The door knob of claim 38, wherein the at least one object comprises two or more objects.

41. Door knob having light-emitting location indicator and door, comprising:

a) a vertically inclined door;

b) a door knob directly or indirectly mounted to the door; the door knob comprising:

i) a main axis orthogonal to a main surface of the door;

ii) protective translucent material having a maximum cross-sectional area taken along said main axis; the maximum cross-section area having a maximum dimension; and iii) the dimension of the knob along said main axis being at least 50 percent of said maximum dimension;

c) at least one object comprising light-emitting material that either phosphoresces or luminesces, without an electrical power source, mounted within the knob and being visible through the protective translucent material;

d) the at least one object being sized sufficiently smaller from the size of the protective translucent material so that the at least one object appears as different from said protective translucent material;

e) the light-emitting material being designed to emit light in a darkened space to thereby visually indicate the location of the knob in the darkened space; and f) the at least one object being sufficiently surrounded by the protective translucent material as to appear floating within the protective translucent material as viewed in a direction parallel to said main surface.

42. The combination of claim 19, wherein door knob is mounted to the door with a screw aligned with said main axis of the door knob.

43. The combination of claim 41, wherein door knob is mounted to the door with a screw aligned with said main axis of the door knob.

44. The combination of claim 19, wherein said maximum cross-sectional area is at least four times as large as said cross-sectional area of said portion of the door knob.

* * * * *